US005273109A

United States Patent [19]

Arizmendi et al.

[11] Patent Number: 5,273,109

[45] Date of Patent: * Dec. 28, 1993

[54] RETRIEVABLE PACKER

[76] Inventors: Napoleon Arizmendi, 10026 Blackhawk, Houston, Tex. 77089; Richard P. Rubbo, 54 Dunecht Gardens, Westhill, Aberdeen, Scotland; Henry J. Jordan, Jr., Rte. 1, Box 456-F, Huntsville, Tex. 77340

[ * ] Notice: The portion of the term of this patent subsequent to Mar. 28, 2010 has been disclaimed.

[21] Appl. No.: 640,068

[22] Filed: Jan. 11, 1991

[51] Int. Cl.[5] ..... E21B 33/129

[52] U.S. Cl. ..... 166/123; 166/134; 166/138

[58] Field of Search ..... 166/120, 123, 125, 134, 166/137, 387, 138

[56] References Cited

U.S. PATENT DOCUMENTS

| | | | |
|---|---|---|---|
| 3,507,327 | 4/1970 | Chenoweth | 166/134 |
| 3,603,388 | 9/1971 | Current et al. | 166/120 |
| 3,747,674 | 7/1973 | Murray | 166/98 |
| 4,307,781 | 12/1981 | Preston et al. | 166/123 |
| 4,518,037 | 5/1985 | Youngblood et al. | 166/125 |
| 4,593,765 | 6/1986 | Greenle | 166/387 |
| 4,610,300 | 9/1986 | Mullins et al. | 166/134 |
| 4,664,188 | 5/1987 | Zunkel et al. | 166/134 |
| 4,750,564 | 6/1988 | Pettigrew et al. | 166/387 |
| 4,778,008 | 10/1918 | Gonzalez et al. | 166/387 |
| 4,830,103 | 5/1989 | Blackwell et al. | 166/387 |

*Primary Examiner*—Ramon S. Britts
*Assistant Examiner*—Frank S. Tsay

[57] ABSTRACT

The apparatus of the present invention is a retrievable packer which provides for release between a mandrel and a packing element support structure by virtue of a rotational movement The apparatus is configured so that the packer can be set by letting up on a tubing string or, in some applications where sufficient weight is unavailable, by pulling up on the tubing string. The slips feature a locking mechanism to secure the packing element against the wellbore W. A release mechanism is provided to defeat the lock mechanism and to act upon the slips to draw them inwardly so the apparatus can be removed from the wellbore W.

44 Claims, 9 Drawing Sheets

SET
46
52
160
136
27
31
108
112
110
114
104
28
106
172
92
94
88
86
25
90
23
84
22
24
17
82
18
21
80
20
16
116
124
132
18
76
15
S
130
82
66
14
158
W
148
138
122
140

61
162
158
164
54
RELEASING 24
18
20
18
88
80
15

36
120
128
33

56
RELEASED 24
26
22
21
18
20
18
17

126
34
34
152

RETRIEVABLE PACKER

FIELD OF THE INVENTION

The field of this invention relates to retrievable packers for downhole use in production and exploration for hydrocarbons in a wellbore.

BACKGROUND OF THE INVENTION

Typically, packers are used to isolate the annulus around the tubing from the zone to be perforated and for other applications where specific zones in the wellbore are to be isolated. "Spacing out" of the tubing at the wellhead in specifically the position desired has been a problem with designs used in the past. The reason the exact depth of placement of the sealing members is unknown is in the nature of the design of prior packers. Most of the prior designs have required the packer assembly to be lowered on a tubing string. The packer assembly was mounted on a mandrel which rode with the packer assembly until the desired depth is reached. In past designs, the release between the packer assembly and the mandrel has occurred by a combined motion requiring letting up on the tubing string or allowing it to come down, while at the same time applying a rotational force, with the result being a disengagement between the mandrel and the packing element support structure. The problem with this operation has been that the combined axial and rotational movement can result in an uncertainty as to when the necessary rotation to create the release has taken place.

The apparatus of the present invention addresses the problem of uncertainty of placement of the packer by providing a release mechanism between the mandrel and the packing element support structure which is actuated by a simple rotation without any axial movement of the tubing string to effect disengagement between the mandrel and the packing element support structure.

Another potential problem in known packers occurs when it is desired to set the packer at a fairly shallow depth from the surface. In those applications, the weight of the tubing string may be insufficient upon disengagement between the mandrel and the packing element support structure to place sufficient longitudinal force to be transmitted from the mandrel to the packing element support structure to sufficiently actuate the packing elements and the slips. The slips grip the wellbore to secure the position of the packing elements. The apparatus of the present invention addresses this problem by providing two alternative means to actuate the slips and the packing elements by relying in most cases on the weight of the tubing string to put sufficient force on the packing element support structure to actuate the slips and the packing elements. Alternatively, means are provided between the mandrel and the packing element support structure to actuate the slips and the packing elements by an upward pull on the tubing string rather than relying on letting up on the tubing string and using its weight to actuate the packer.

Another concern in packers of prior designs, especially those that have attempted to employ slips above and below the packing elements in a design featuring a removable option, has been the difficulty in getting the slips to let go of the casing when it is time to retrieve the packer. Related to this problem has been the concern of obtaining sufficient bite of the slips in to the casing or formation and ensuring that there isn't a loosening of the grip by the slips of the casing during operations. The apparatus of the present invention deals with these concerns by providing a locking mechanism to retain the necessary force on the slips and the packing elements, minimizing the possibility that they will let go in use. Additionally, the apparatus of the present invention is so configured that upon initiating the steps to retrieve the apparatus, the previously mentioned locking mechanism is defeated and initial movements of the apparatus components result in a release of the compressive force on the packing elements followed by a force applied to the slips to draw them inwardly to facilitate the release of the apparatus from the wellbore. For the purposes of brevity, all references in this application to wellbore are intended to include applications where the wellbore has a casing at the point of use of the apparatus as well as locations where the wellbore is uncased.

Some prior designs use an "L" or "J" slot to effectuate release between the packing element support structure and the mandrel, such as illustrated in U.S. Pat. No. 4,307,781. Even using this method generates some uncertainty as to the ultimate positioning of the packer since the gripping of the packing elements on the wellbore occurs during the pulling up procedure and there is some uncertainty as to the exact point at which the packing elements and slips will engage. The apparatus of the present invention has attempted to address the uncertainties of placement of the packer by providing a mechanism to effectuate the release of the packing element support structure from the mandrel with a simple rotation. Thereafter, initial slip engagement is preferably obtained prior to packing contact with the wellbore, thus the movement of the mandrel over a known distance creates the initial gripping of the slips and fixes the position of the apparatus, whereupon the packing element is engaged.

SUMMARY OF THE INVENTION

The apparatus of the present invention is a retrievable packer which provides for release between a mandrel and a packing element support structure S by virtue of a rotational movement. The apparatus is configured so that the packer can be set by letting up on a tubing string or, in some applications where sufficient weight is unavailable, by pulling up on the tubing string. The slips feature a locking mechanism to secure the packing element against the wellbore W. A release mechanism is provided to defeat the lock mechanism and to act upon the slips to draw them inwardly so the apparatus can be removed from the wellbore W.

BRIEF DESCRIPTION OF THE DRAWINGS

FIGS. 4A–4C show the bypass open, and FIGS. 5A–5C show the "casing saver system" actuated.

DETAILED DESCRIPTION OF THE PREFERRED EMBODIMENT

Figures 1A, 1B, 1C:
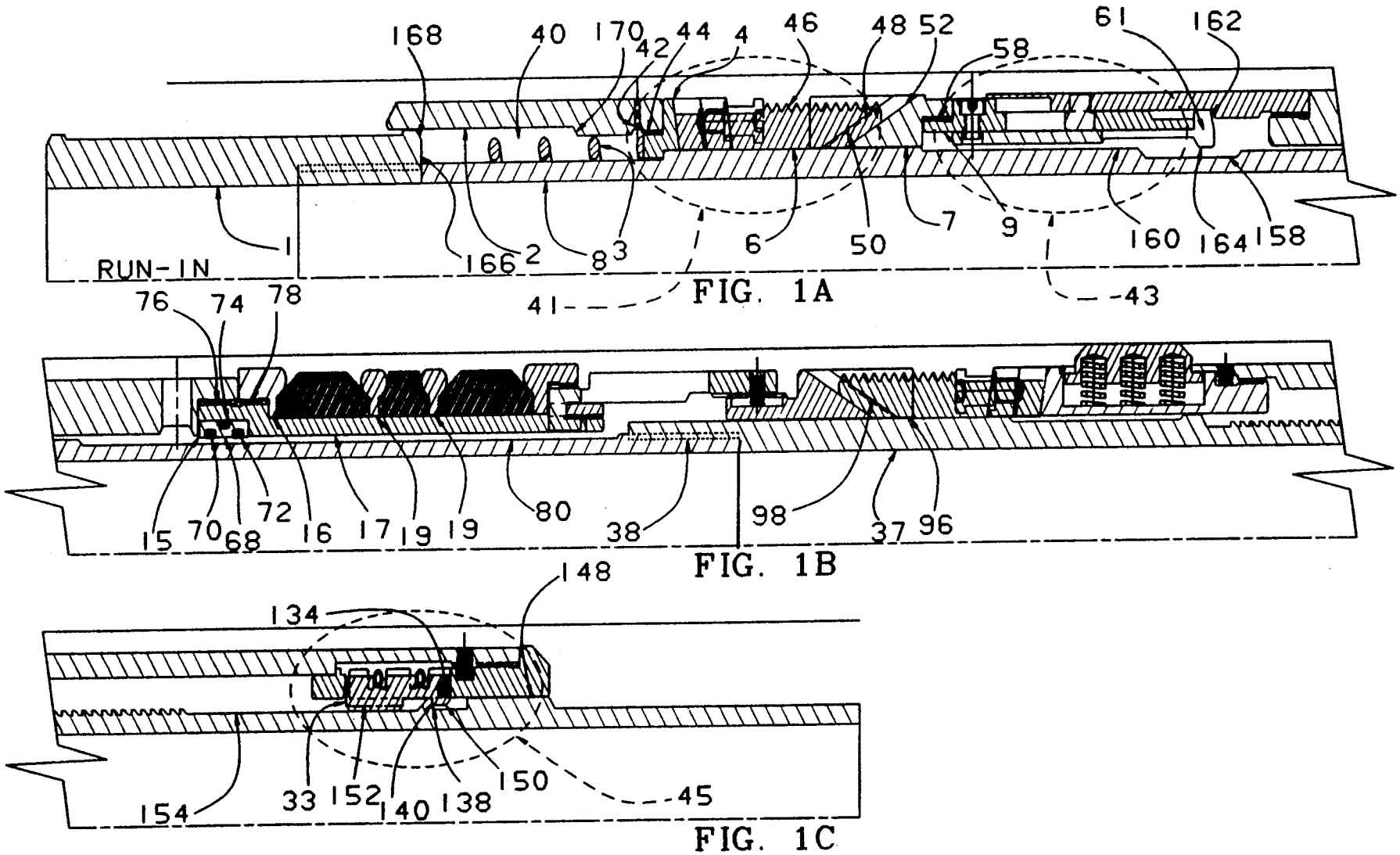
FIGS. 1A–1C are sectional views of the apparatus in the run-in position or the fully released position.
Figures 2A, 2B, 2C:
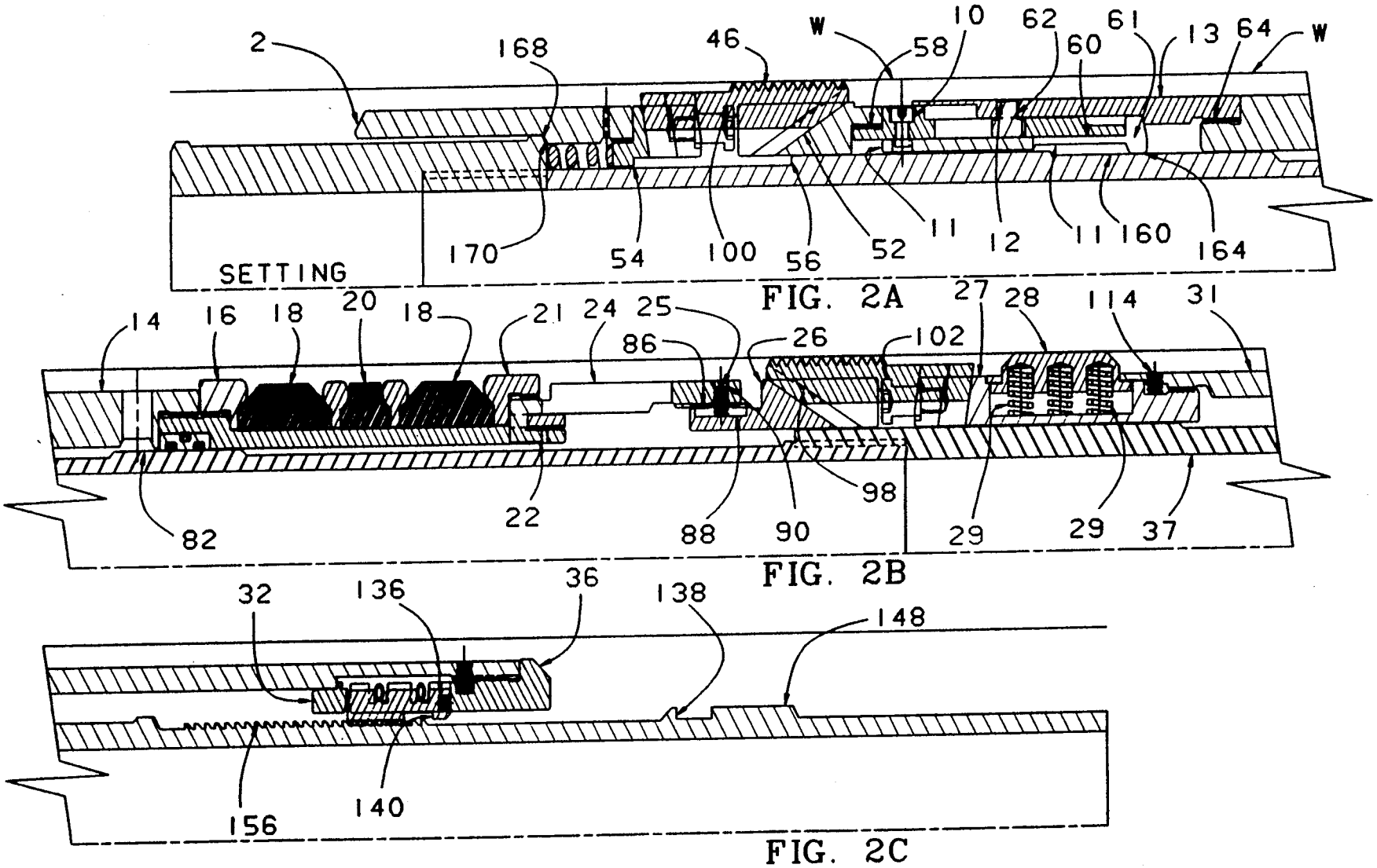
FIGS. 2A–2C are the same views as FIGS. 1A–1C with the apparatus in the setting position.
Figures 3A, 3B, 3C:
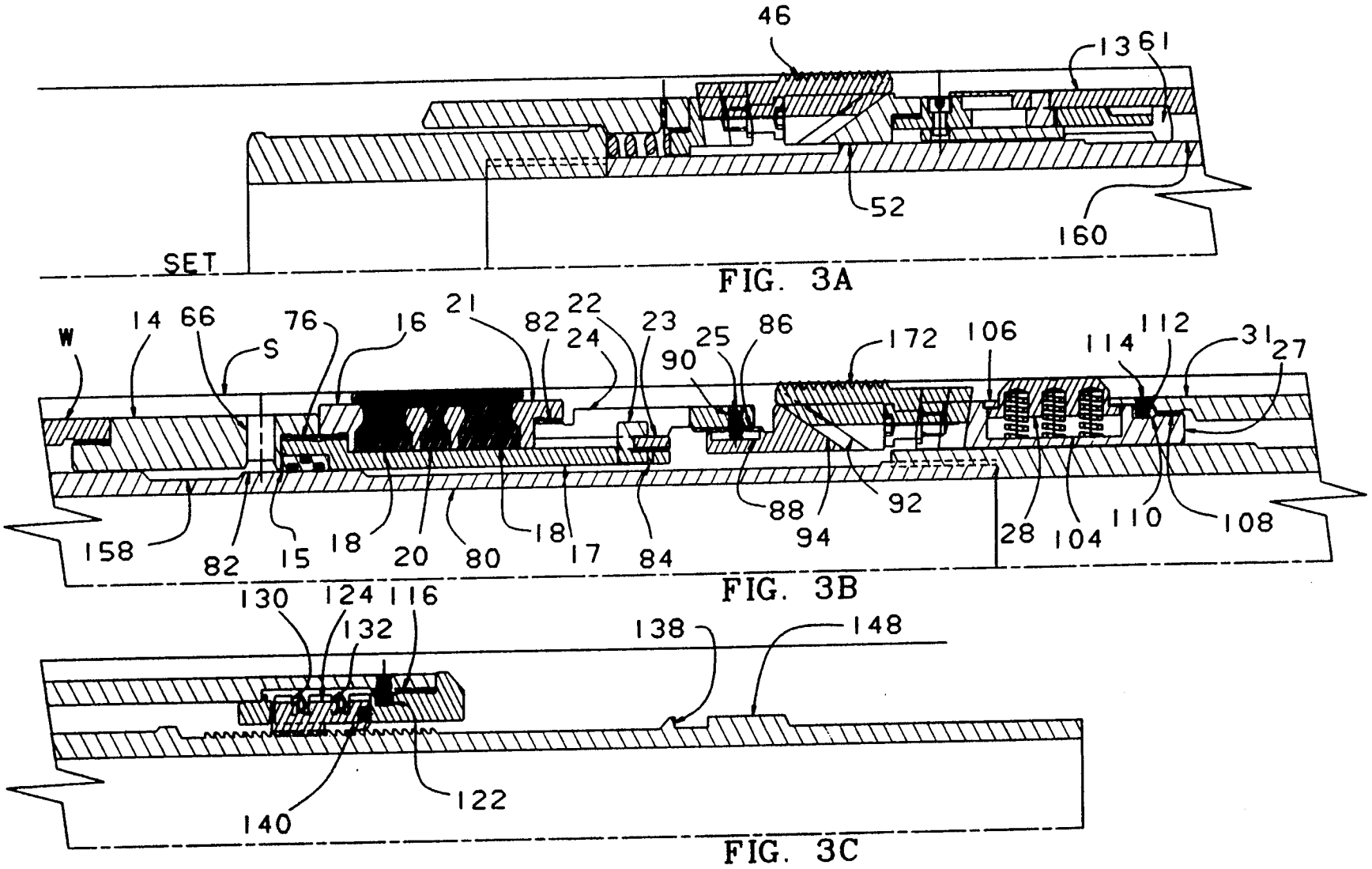
FIGS. 3A–3C show the apparatus in the set position.
Figures 4A, 4B, 4C:
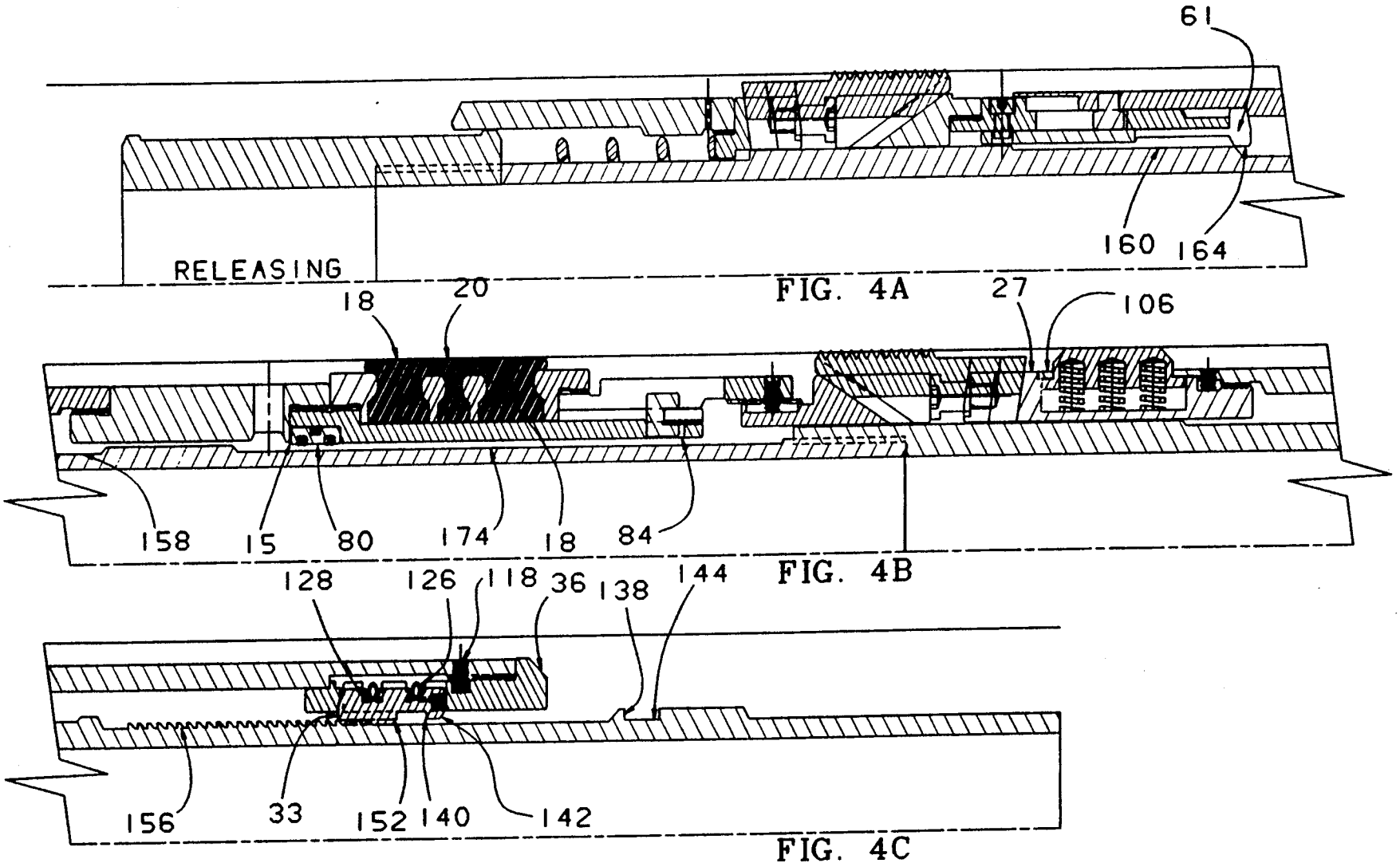
FIGS. 4A–4C and 5A–5C show the apparatus in different positions during, the releasing.
Figures 5A, 5B, 5C:
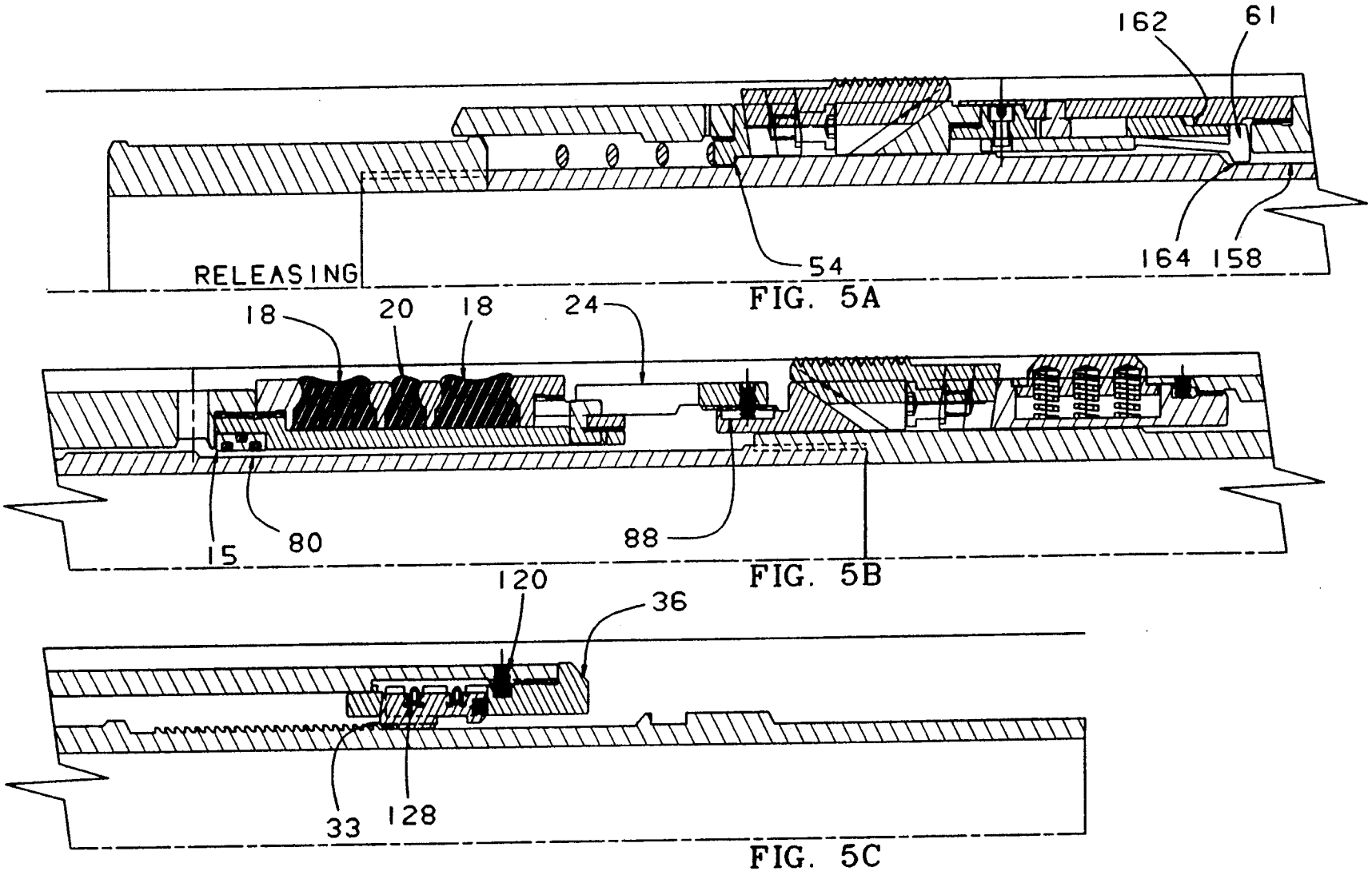
Figures 6A, 6B, 6C:
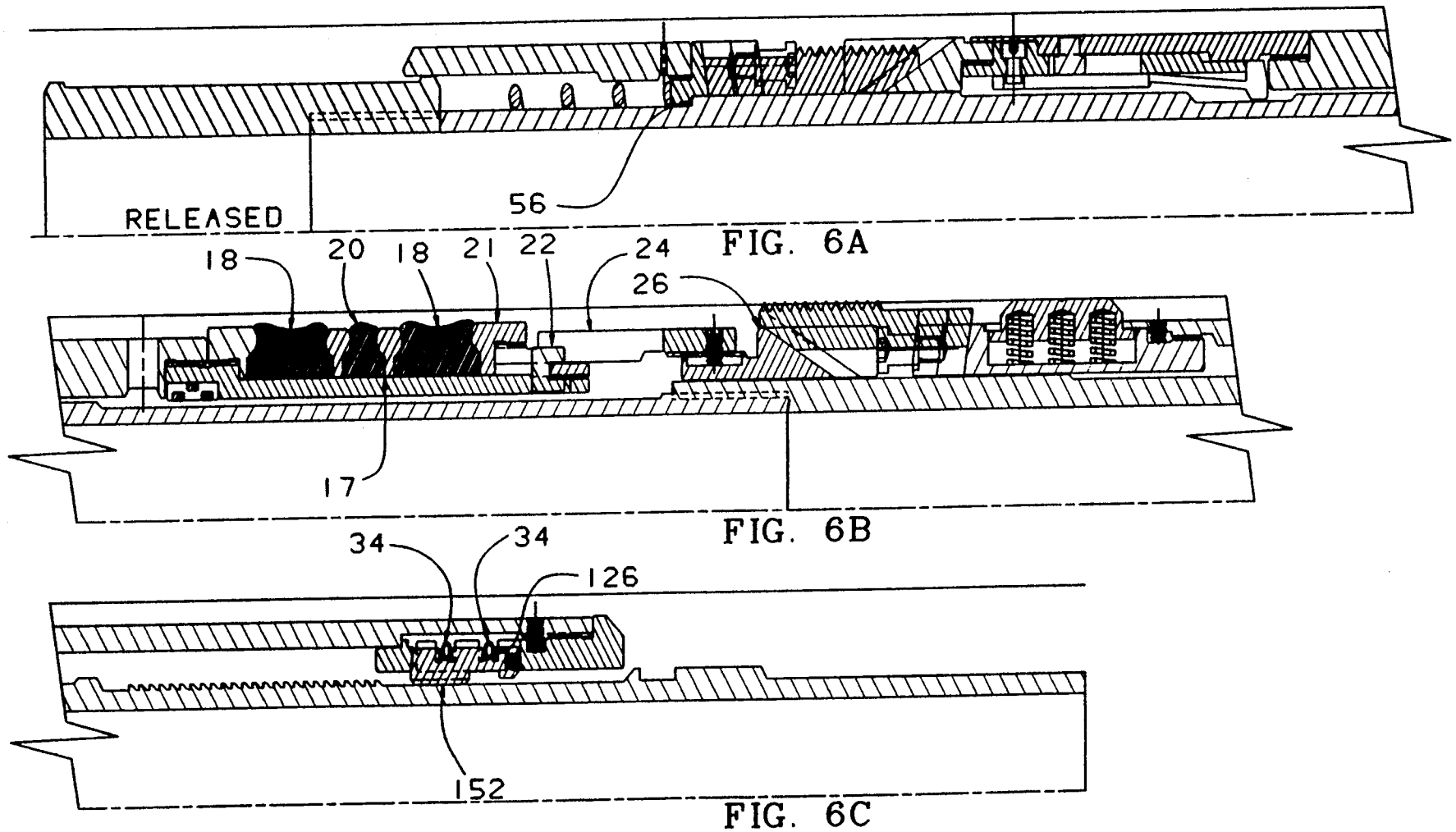
FIGS. 6A–6C show the apparatus with the upper slips fully retracted for removal from the wellbore W.

Referring now to FIG. 1, the apparatus of the present invention will be described from top to bottom. A top connection 1 is used to connect the apparatus to a tubing string (not shown). Upper mandrel 8 is connected to top connection 1, and lower mandrel 37 is threadedly engaged to upper mandrel 8 at threads 38. The mandrel can also be made in one piece without departing from the spirit of the invention, but in the preferred embodiment is shown in two components, the upper mandrel 8 and the lower mandrel 37. Spring 3 circumscribes the upper mandrel 8 adjacent top connection 1. Mounted over spring 3 is spring housing 2, effectively creating a chamber 40 in which spring 3 is housed. As seen from FIGS. 2-4, the volume of chamber 40 is variable and vent hole 42 allows any trapped fluids to escape to allow for the reduction in volume of chamber 40. The spring housing 2 is threadedly connected to slip ring 4 via threads 44. Slip ring 4 holds upper slip 6. In the preferred embodiment, five upper slips 6 are used, although the number of slips used can vary, depending upon the size of the tool and the requirements of the application. Upper slips 6 have a serrated surface (wicker) 46 which, as shown in FIGS. 2 and 3, can be actuated into contact with the wellbore W. As previously noted, references to wellbore W are intended to be inclusive of the formation as forming the wellbore W or a casing installed in the wellbore. The slips 6 have a pair of opposed inclined surfaces 48, one of which, on one side of wicker 46, is shown in hidden lines on FIG. 1. The inclined surfaces 48 match similar inclined surfaces 50 of upper cone 7. In effect, cone 7 traps upper slips 6 for relative slidable movement of upper slips 6 along ramp 52 for outward movement of slips 6, as shown in FIG. 2, and for inward movement between opposed surfaces 48 and 50, as shown in FIGS. 5 and 6. This occurs while releasing the tool when shoulder 54 abuts shoulder 56 (see FIGS. 5 and 6). Shoulder 56 is on upper mandrel 8, while shoulder 54 is on slip ring 4. As shown in FIG. 2, during the setting operation shoulders 54 and 56 move apart.

Upper cone 7 is threadedly engaged in collet support 9 (see FIG. 1) at threads 58. At least two screws 10 extend through collet support 9 and into collet member 11 (see FIG. 2). Screw 10 prevents relative rotation between the collet support 9 and collet assembly 11. The screw 10 also provides the means by which the collet is repositioned during the releasing sequence into the run-in position, as shown in FIG. 1. The collet assembly 11 is annularly shaped, having a lower end from which a plurality or collet ringers 60 (see FIG. 2) extend generally parallel to upper mandrel 8 for selective contact therewith, as will be described below. The actual collet head 61 is at the lower end of collet fingers 60. The number of collet fingers and collet heads depends on the size of the tool and the particular application. Extending over collet fingers 60 and collet heads 61 is collet housing 13. Collet housing 13 has at least two openings 62, through which extends upper locking segment 12. In the preferred embodiment, two segments 12 are provided; however, more or less of segments 12 can be employed without departing from the spirit of the invention. Upper locking segments 12 prevent relative rotation between collet support 9 and collet housing 13. Collet housing 13 is threadedly connected to bypass sub 14 at threads 64. A plurality of holes 66 allow fluid communication through bypass sub 14 to the wellbore W around end packing 18 and center packing 20 when bonded seal 15 disengages upper mandrel 8 (FIGS. 1 and 4). As shown in FIG. 1, seal 15 is composed of a carrier ring 68 containing two internal seals 70 and 72 and a radially external seal 74. Seal 74 is in continuous contact with packing element mandrel 17. Packing element mandrel 17 is threadedly connected to bypass sub 14 via threads 76. Packing element mandrel 17 is also threadedly connected to upper gauge ring 16 via threads 78. Seals 70 and 72 are selectively in axial alignment with depressed surface 80, as shown on FIG. 1. During the setting operation, as shown in FIGS. 2 and 3, seals 70 and 72 come in contact with surface 82 on upper mandrel 8. When this occurs, there is a sealing contact between packing element mandrel 17 and upper mandrel 8 to prevent bypassing of fluid behind the packing elements 18 and 20 when they contact the wellbore W, as illustrated in FIGS. 3 and 4. As shown in FIG. 1, spacers 19 are disposed on either side of center packing element 20 and are schematically shown to be covered up in FIG. 3 when the packing elements 18 and 20 are fully compressed against the wellbore W.

At the lower end of end packing element 18 is lower gauge ring 21. Lower gauge ring 21 is threadedly connected to adjustment sleeve 24 at threads 82.

Packing element mandrel 17 has at least two openings 84, through which extends lower locking segment 22. Lower segment retainer 23 effectively holds lower locking segment 22 within opening 84 of packing element mandrel 17. Lower locking segments 22 in the preferred embodiment are made of two segments, although a different number of segments can be used without departing from the spirit of the invention. Lower locking segments 22 are locked against rotation with respect to adjustment sleeve 24 via the extension of lower locking segments 22 into longitudinal slots (not shown) cut out of adjustment sleeve 24. The relative positions of lower locking segment 22 with respect to adjustment sleeve 24 can be seen by comparing FIGS. 2 and 3.

The lower end of adjustment sleeve 24 is threadedly connected to lower cone 26 at threads 86. At least two longitudinal slots 88 extend through the portion of thread 86 mounted to lower cone 26. Screw 25 extends through a threaded bore 90 and into slot 88 to prevent relative rotation between lower cone 26 and adjustment sleeve 24. Lower cone 26 has a pair of ramped surfaces 92 and 94 between which are disposed the lower slips 96. Slips 96 have opposing ramped surfaces 98, represented by the dotted line in the figures, which move between surfaces 92 and 94. Preferably, the construction of the slips 6 and 96 is identical, while they have opposite orientations, as shown in the figures. When assembling the slips 6 or 96 to their respective cones 7 or 26, bolts 100 and 102 are thereafter installed to act as travel stops, respectively, for slips 6 and 96 to keep them from falling out of the apparatus. In essence, a multiplicity of bolts 100 and 102 are used, one for each slip employed, to act as travel stops, respectively, for slips 6 and 96. As with slip 6, the number of slips 96 that can be used depends upon the size of the apparatus and the application. Lower slips 96 are retained by drag block housing 27. At its upper end, drag block housing 27 resembles the construction of slip ring 4, but it further features a depressed segment 104 within which are mounted drag blocks 28. Drag blocks 28 are outwardly biased by coiled springs 29. The number of springs used varies with the application. In the preferred embodiment, four drag blocks 28 are used, each of which is outwardly biased by six coiled springs 29. Control segment housing 31 overlays depressed segment 104 of drag block housing 27 to trap drag blocks 28 from falling out of the apparatus. On the opposite end of drag blocks 28, a ring 106 is connected to the drag block housing 27 to further trap the drag blocks 28.

Drag block housing 27 is threadedly connected to control segment housing 31 at threads 108. Drag block housing 27 has a groove 110 adjacent threads 108. Control segment housing 31 has a threaded opening 112 which accepts a bolt 114, further assisting in the connection between drag block housing 27 and control segment housing 31 by extension of bolt 114 through opening 112 into groove 110.

Figure 7:
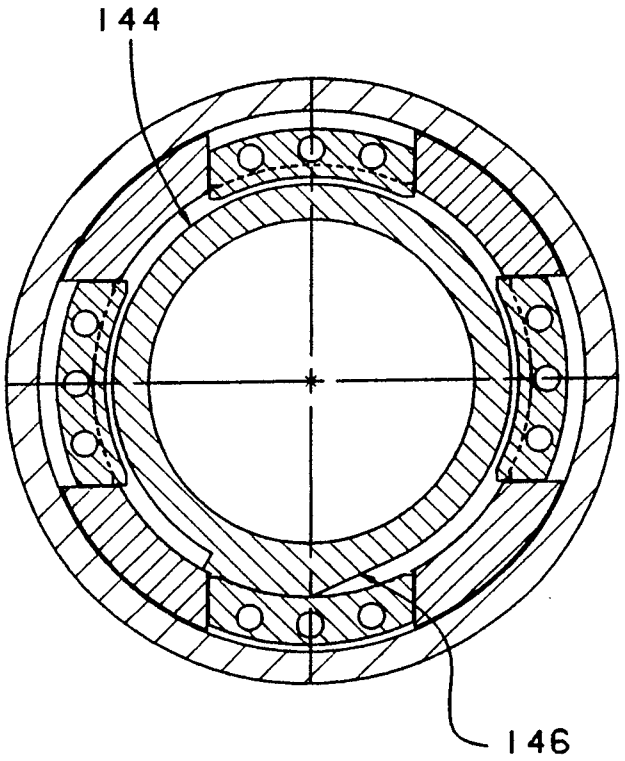
FIG. 7 is a sectional view.
Figure 10:
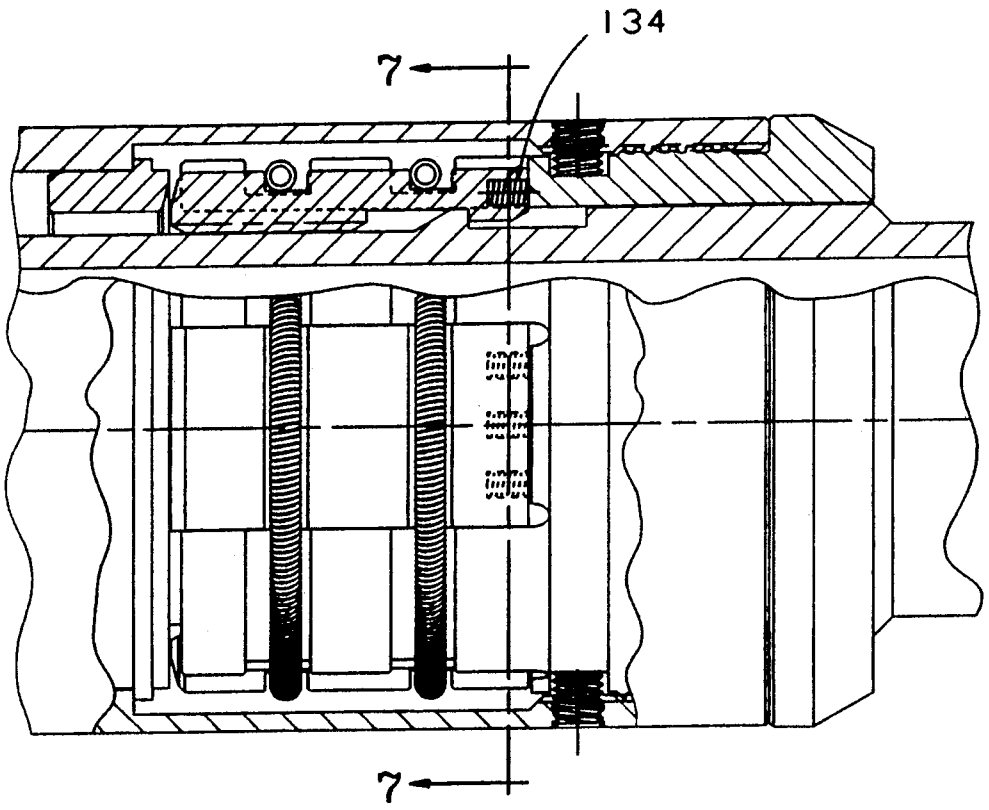
FIG. 10 is an enhanced view of Circle 45 in FIG. 1.
Figure 12:
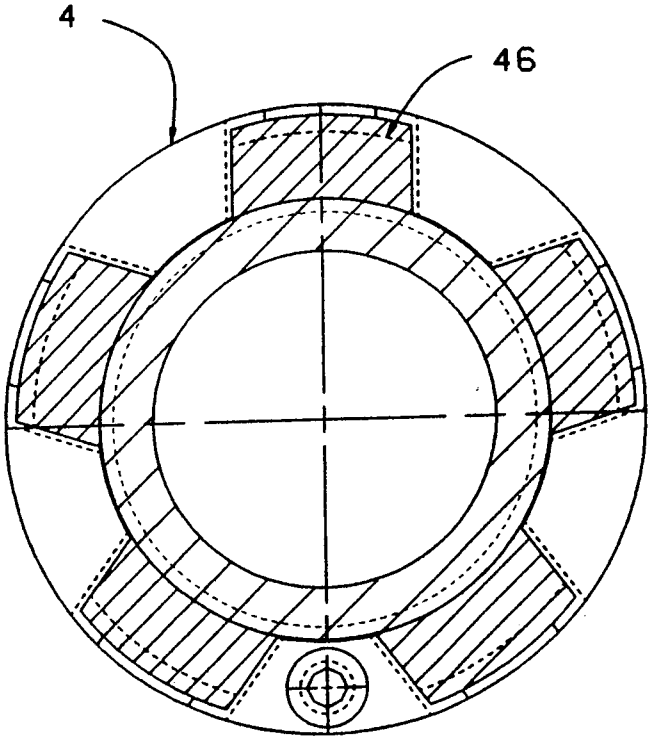
FIG. 12 is a sectional view taken along lines 12—12 shown in FIG. 8.
Figure 8:
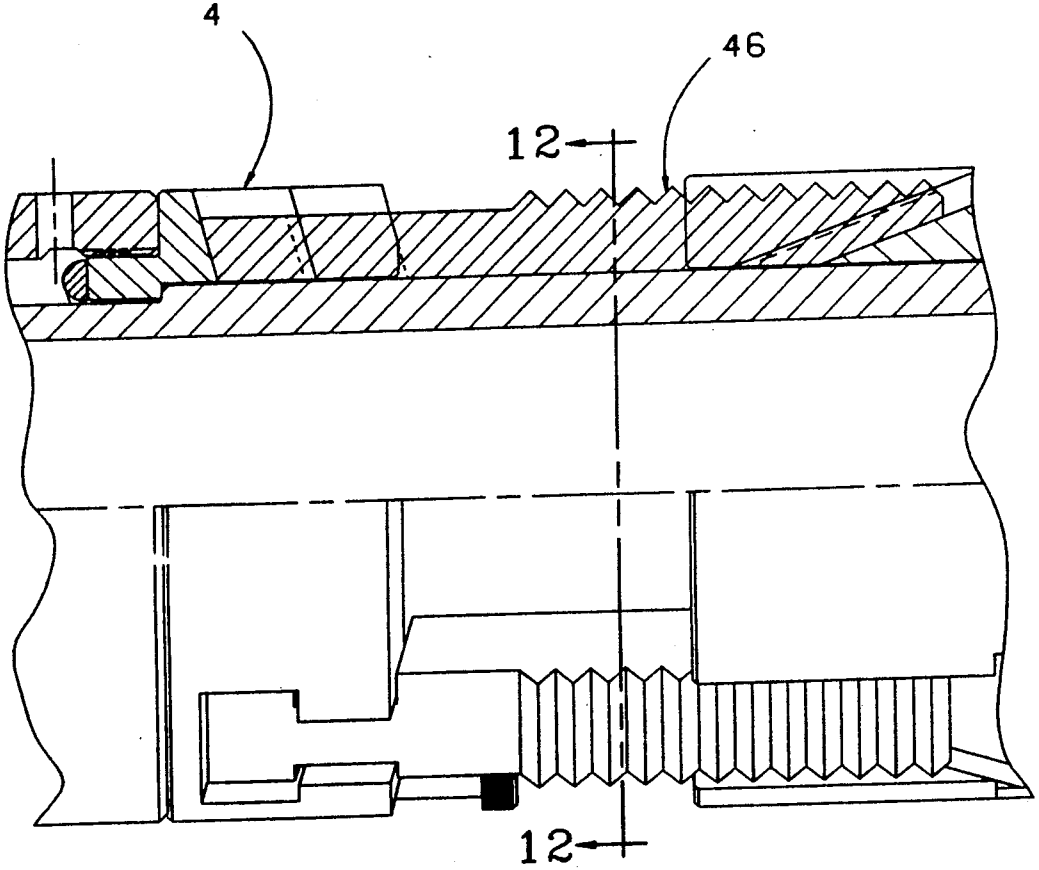
FIG. 8 is an enhanced view of Circle 41 in FIG. 1.
Figure 11:
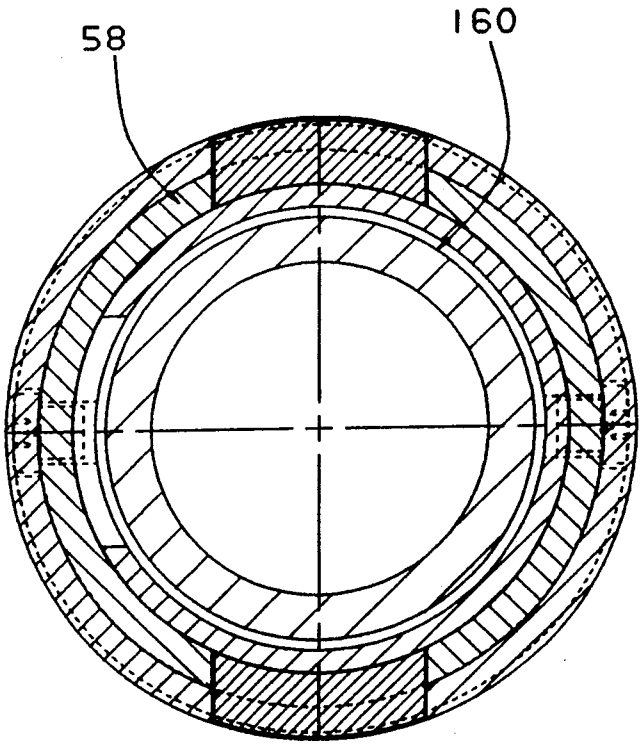
FIG. 11 is a sectional view taken along lines 11—11 shown in FIG. 9.
Figure 9:
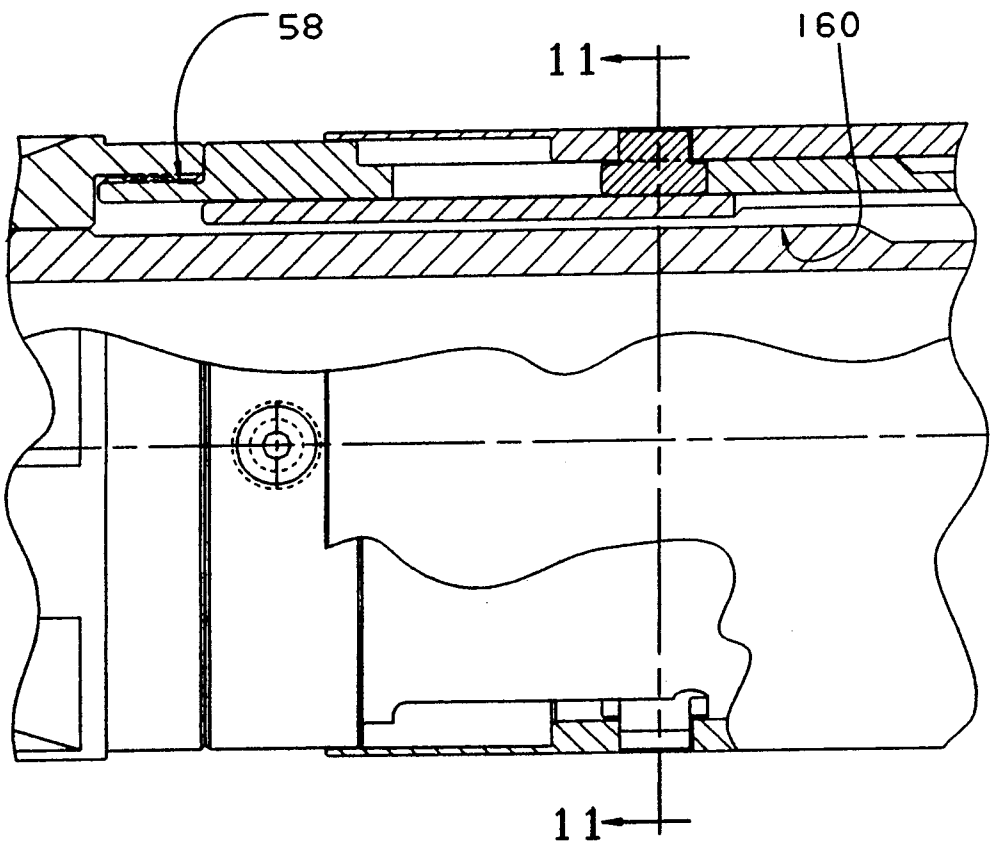
FIG. 9 is an enhanced view of Circle 43 in FIG. 1.

At the lower end of control segment housing 31 is guide ring 36. Guide ring 36 is threadedly connected to control segment housing 31 at threads 116. A bolt 118 extends through a threaded opening 120 into groove 122 of guide ring 36. Guide ring 36 has a plurality of slots extending longitudinally which accommodate control segments 33. Extending from the outer surface 124 of control segments 33 are peripheral grooves 126 and 128. Grooves 126 and 128 are in general alignment with grooves 130 and 132, which are part of guide ring 36. The difference between these pairs of aligned grooves, as illustrated in the figures, is that the longitudinal length of grooves 130 and 132 is longer than the corresponding lengths of grooves 126 and 128. Garter springs 34 circumscribe the control segments 33 in grooves 126 and 128 to draw the control segments 33 inwardly. Each of the control segments 33 is axially biased by least one spring (whose centerline) 134 is shown in the figures. The spring is mounted in a recess 136 of each control segment 33 so that longitudinal biasing force is continually exerted by the spring 134 on control segments 33. As seen in FIGS. 1 and 2, shoulder 138 disposed on lower mandrel 37 engages shoulder 140 to overcome the force exerted by springs 134 on control segments 33. Any number of springs 134 can be used for each of the control segments 33, depending upon the size of the tool and the application. Shear ring 32 is connected to control segment housing 31 to act as a travel stop to retain the control segments 33 within guide ring 36. As seen in FIG. 4, shoulder 140 is part of a projection 142 which extends radially inwardly from each of the control segments 33 into a groove 144 on lower mandrel 37. Shoulder 138 is one portion of groove 144. As shown in FIG. 7, groove 144 does not extend circumferentially all the way around lower mandrel 37. Instead, for at least a portion of the outer periphery of lower mandrel 37 in the area of groove 144, there is a ramp out 146 which, in effect, eliminates groove 144 and for that segment at the peak of ramp 146, the outer surface of lower mandrel 37 comes up in alignment with adjacent surface 148. Those skilled in the art will observe that rotation of lower mandrel 37 will serially radially outwardly displace control segments 33 when the top of ramp 146 comes adjacent to surface 150 (see FIG. 1), forcing the control segment radially outwardly to the extent that shoulder 140 disengages from shoulder 138, whereupon springs 134 bias control segments 33 axially, thereby "unlocking" the lower mandrel 37 from what will be generically referred to as the packing element support structure S, which is intended to be inclusive of the assembled components in alignment with upper and lower mandrels 8 and 37, respectively, beginning with item 2, the spring housing, and extending down to the guide ring 36. The axial displacement caused by springs 134 allows shoulder 140 to clear shoulder 138, permitting relative movement of the mandrels 8 and 37 with respect to the packing element support structure S.

Before describing in detail the operational movements of the apparatus, a few more details need to be described. As shown in FIG. 1, the control segments each feature a serrated surface 152 which is in contact with surface 154 of lower mandrel 37 when the tool A is being run in, as shown in FIG. 1. Serrated surface 152, as it appears on each control segment 33, is actually part of a thread form. After disengagement between shoulders 138 and 140, as will be described in more detail below, the tubing string connected to top connection 1 is allowed to come down, lowering upper and lower mandrels 8 and 37, bringing serrated surface 152 in contact with serrated surface 156 on lower mandrel 37. As shown in FIG. 2, upper and lower mandrels 8 and 37 can be further lowered, with the result being that serrated surface 156 will ratchet over serrated surface 152 by serially displacing control segments 33 radially outward against the forces of garter springs 34 to allow further downward movement of lower mandrel 37 to initiate setting of the apparatus in the wellbore W. However, if the tubing string receives an upward pull when serrated surfaces 152 and 156 are in engagement, there will be no ratcheting effect; instead there will be a gripping of lower mandrel 37 to control segments 33 for actuation of the apparatus under special circumstances, as will be described below.

Moving now to the lower end of upper mandrel 8, the depressed surface 80 has been described as one that defeats seal 15 when in radial alignment therewith, as shown in FIG. 1. As shown in FIG. 3, there is effective sealing behind packing elements 18 and 20 when surface 82 comes into alignment with seal 15. Adjacent surface 82 is depressed surface 158. Depressed surface 158 is bounded on one side by surface 82, which, as previously described, selectively contacts seal 15, and on the other side by surface 160. As shown in FIG. 1, when depressed surface 158 is in alignment radially with collet heads 61, the collet heads are unlocked and are free to move radially inwardly (FIG. 1). Collet heads 61 can become trapped against collet housing 13 when the collet heads 61 engage a shoulder 162 and surface 164 engages surface 160, as shown in FIG. 2. As shown in FIGS. 4 and 5, to release the collet heads 61, depressed surface 158 is brought back in approximate axial alignment with collet heads 61, thereby allowing the collet heads 61 to be deflected radially inwardly, as shown in FIG. 5, to release upper slips 6.

The major components of the apparatus now having been described, the operation of the apparatus in its various positions can be understood. FIG. 1 refers to the apparatus in the run-in position, which is the position it would have as it is being lowered into the wellbore W to the desired depth. Having achieved the desired depth, it is then desirable to disengage the lower mandrel 37 and upper mandrel 8 from the packing element support structure S. This is accomplished by putting a rotational force on upper mandrel 8 and lower mandrel 37, which results in rotation of ramp 146 serially into contact with the control segments 33. What in effect occurs is that groove 144 is serially replaced with a surface extending radially outwardly in substantial alignment with surface 148, which results in radially outward displacement of control segments 33. The radial outward displacement of control segments 33 pushes shoulders 140 and 138 out of contact to allow biasing elements or springs 134 to push control segments 33 in an axial upward direction. It should be noted that while the control segments 33 are being radially outwardly displaced, the garter springs 34, which wrap around the control segments 33, as well as guide ring 36 resist this outward force on control segments 33. However, the ramp 146 overcomes the forces generated by garter springs 34, which results in a series of movements of control segments 33, first outwardly until shoulders 140 and 138 clear each other, and then axially as springs 134 take effect on control segments 33. It should be noted that due to the relative longitudinal length and depth as between grooves 130 and 132 compared to grooves 126 and 128, the radial outward displacement of control segments 33 does not put garter springs 34 outside of grooves 130 and 132. This arrangement helps to retain the control segments 33 to the guide ring 36 and limits the amount of axial movement of the control segments 33 due to the force of springs 134. The shear ring 32 also helps to limit the extent of axial travel of control segments 33.

An examination of FIG. 7 will reveal that a rotational movement of lower mandrel 37 in the order of approximately 270 degrees will, in effect, result in all of the shoulders 140 clearing the respective shoulders 138 on lower mandrel 37. Having accomplished this, the assembly of upper mandrels 8 and 37 can be further lowered to actuate the apparatus.

Those skilled in the art will appreciate that as the apparatus is being lowered into the wellbore W, the drag blocks 28 are outwardly biased by springs 29 and make contact with the wellbore W. As the apparatus is being lowered, it can be seen that the drag force applied to the apparatus by the drag blocks 28 is overcome by shoulder 138 bearing down on shoulder 140. As a result, the packing element support structure S moves down in tandem with upper and lower mandrels 8 and 37 until the desired depth is reached. The other components of the apparatus are in the position shown in FIG. 1 until the desired depth is reached and further downward movement of the packing element support structure S ceases. At that point, the drag blocks 28 in effect hold up the packing element support structure S as the lower mandrel 37 receives a mere rotational force of approximately 270 degrees, which results in the disengagement between the control segments 33 and the lower mandrel 37.

Thereafter, lower mandrel 37 is lowered, as shown in FIG. 2. While the lower mandrel 37 is being lowered, the packing element support structure S is retained in a stationary position due to the use of drag blocks 28. Once the weight of the packing element support structure S has been transferred to drag blocks 28, the weight of the components between drag block housing 27 and spring housing 2 cause some initial outward movement of slips 6 and 96 into contact with the wellbore W, as shown in FIG. 2. Simultaneously, while the upper and lower mandrels 8 and 37 are being lowered, chamber 40 starts to get smaller as fluids are outwardly displaced through vent opening 42. Initially, surface 166 of top connection 1 engages spring 3 such that further downward movement of upper and lower mandrels 8 and 37 transmits an axial downward force on the components of the packing element support structure S, beginning with slip ring 4. By the time there is engagement between surface 166 and spring 3, shoulders 54 and 56 have sufficiently separated so that the spring force of spring 3 can be axially transmitted to slip ring 4 for further outward actuation of slips 6 and 96, as well as the packing elements 18 and 20. Top connection 1 also has a surface 168, which ultimately comes into contact with surface 170 on spring housing 2. Contact between surfaces 168 and 170 is illustrated in FIG. 2. At that point, any further letting up on the tubing string connected to top connection 1 results in direct axial forces applied by top connection 1 onto spring housing 2, as well as a continuation of a spring force generated by spring 3 applied directly to slip ring 4, which is threadedly connected to spring housing 2 at threads 44. Throughout this operation, drag blocks 28 have held up the packing element support structure S until slips 6 and 96 have made sufficient contact with the wellbore W to hold up packing element support structure S.

As the mandrels 8 and 37 are further lowered, the axial forces applied initially by spring 3 force slip ring 4 against slips 6, which causes the slips 6 to try to axially move, whereupon ramp 52 begins to urge the slips 6 outwardly, as shown in FIG. 2. The cone 7 is also axially displaced in the process. Cone 7 is rigidly connected to collet support 9. The axial force is transmitted through the collet support 9 and into the collet head 61 and into the collet housing 13 through shoulder 162. Collet housing 13 is threadedly connected to bypass sub 14, which in turn bears on lower locking segment 22, which is then free to move in grooves on adjustment sleeve 24. With the weight of packing element support structure S on drag blocks 28, the weight of lower cone 26 and adjustment sleeve 24 apply an axial force on slips 96 through ramp surface 94, thereby outwardly displacing slips 96.

The sequence of movement between FIGS. 1 and 2 calls for an initial bite of slips 96 into the wellbore W, followed by slips 6. At this point, as shown in FIG. 2, the slips 6 and 96 have not fully dug into the wellbore W, but have obtained a sufficient bite to overcome the effect of drag blocks 28. At this point, the packing elements 18 and 20 have not yet seated on the wellbore W.

After the slips 6 and 96 have obtained their initial bite, the apparatus is put into the set position by moving it from the position shown in FIG. 2 to the position shown in FIG. 3. As shown in FIG. 2, when the slips 6 and 96 obtain their initial bite, the collet heads 61 have become trapped between shoulder 162 and surface 160 and the collet support shoulder. At that point, any further axial movement of cone 7 due to forces applied from top connection 1 or spring 3 will be directly translated through the collet heads 61 to collet housing 13 to bypass sub 14. Also at that point, seal 15 has engaged surface 82 to effectively seal behind packing elements 18 and 20.

Comparing now FIG. 3 to FIG. 2, it can be seen that there has been further downward movement of mandrels 8 and 37, by manipulation of a tubing string connected to top connection 1, which has resulted in compression of packing elements 18 and 20. The compression has occurred due to continuing axial forces applied by top connection 1 and spring 3. These forces, with slips 6 engaging the wellbore W, are axially transmitted to ramp surface 52, which are in turn, due to the trapping of collet heads 61, fully transmitted through collet housing 13 onto bypass sub 14. As stated previously, bypass sub 14 is threadedly connected to packing element mandrel 17, which is relatively movable with respect to adjustment sleeve 24 due to the slots within adjustment sleeve 24, into which lower locking segments 22 are disposed for relative axial translation. By comparing the position of the segments 22 in FIG. 3 to FIG. 2, it will be seen that there has been relative motion of lower locking segments 22 with respect to adjustment sleeve 24 as a result of manipulation from the tubing string at the same surface which is connected to top connection 1. The net result of this relative motion is that upper gauge ring 16, which is also connected to packing element mandrel 17, bears down axially on packing elements 18 and 20, which are capable of responding to axial forces by radially outward deformation and compaction in the axial direction, as shown by the FIGS. 2 and 3 wherein the overall axial dimension of packing elements 18 and 20, for the particular model illustrated, shrink from 6.51 inches to 4.34 inches. This compression of the packing elements 18 and 20 occurs when packing element mandrel 17, along with upper gauge 18 and 20, resulting from a force supplied at the surface through a tubing string connected to top connection 1, and which is resisted by lower gauge ring 21, which is fixedly held through its threaded connection 82 to adjustment sleeve 24, which is in turn retained by lower cone 26, which is held stationary due to the grip of slips 96 into the wellbore W. Upon moving the upper and lower mandrels 8 and 37 down a sufficient distance, the packing elements 18 and 20 are sufficiently outwardly displaced to contact the wellbore W, as shown in FIG. 3. Furthermore, the serrated surface 46 on slips 6 has obtained a complete bite into the wellbore W to the extent, as shown on the drawing, of 0.030 inch. Similarly, the serrated surface or wicker 172 has obtained a similar bite on the wellbore W. As a result, the lower locking segments 22 have further moved, as shown in comparison between FIGS. 2 and 3, to effectively compress the packing elements 18 and 20 and to provide a further force axially through lower gauge ring 21, adjustment sleeve 24 through lower cone 26 and onto lower slips 96. It should be noted that, during the movement of upper and lower mandrels 8 and 37 from the position shown in FIG. 2 to the position shown in FIG. 3, the serrated surface 152 has ratcheted along serrated surface 156 of lower mandrel 37.

The significance of the interaction between serrated surfaces 152 and 156 can now be explained. In situations where the apparatus is to be set at fairly shallow depths, employing a very short tubing string which will have insufficient weight to transmit the necessary downward forces into top connection 1, the apparatus of the present invention can be set in a different manner. The disengagement between the control segments 33 and the lower mandrel 37 proceeds as previously described. The lower mandrel 37 is then lowered, also as previously described, until serrated surface 152 is in contact with serrated surface 156 (in the position shown in FIG. 3). At that point, the direction of motion of upper and lower mandrels 8 and 37 is reversed to apply an upward force to the control segments. The upward force exerted on the control segments 33 forces them into contact with shear ring 32, thereby applying an upward axial force on control segment housing 31. As previously described, when the tool has been lowered to the desired depth, drag blocks 28 support the packing element support structure S. This time when the apparatus is to be actuated by an upward pull on upper and lower mandrels 8 and 37, the supporting force of the drag blocks 28 is overcome by the upward force imparted onto control segment housing 31 through control segments 33 contacting shear ring 32. The initial outward movement of the slips 6 and 96 occurs as in the earlier illustrated example, even before any upward force is applied to control segment housing 31. However, when the upward force is finally applied to the control segment housing 31, the wickers 46 and 172 have already obtained a bite on the wellbore W and the obtaining of a complete bite and compression of packing elements 18 and 20 proceeds in reverse to that previously described. This time, the upward axial forces generated by the contact between serrated surfaces 152 and 156 are transmitted through the control segment housing 31, the drag block housing 27, slips 96, through cone 26, to adjustment sleeve 24, which bears directly onto lower gauge ring 21. It should be kept in mind that the lower locking segments 22 are disposed in slots in adjustment sleeve 24 so that adjustment sleeve 24 is capable of relative upward movement with respect to lower locking segment 22 to actuate the packing elements 18 and 20 by upwardly applied forces generated from the connection of serrated surface 156 on lower mandrel 37 with serrated surface 152 of control segments 33. Further upward pulling on lower mandrel 37 results in the required compression of packing elements 18 and 20 and further biting of wickers 46 and 172 into the wellbore W. It should be noted that the final position when actuating the apparatus of the present invention by an upward pull on lower mandrel 37 with engagement between serrated surfaces 152 and 156, that seals 15 wind up in contact with surface 82, as shown in FIGS. 2 and 3, and collet heads 61 wind up trapped between shoulder 162 and surface 160 on upper mandrel 8 and the collet support 9. The trapping of the collet heads 61 further better permits the transmission of axial forces upwardly from collet housing 13 into upper cone 7 to ensure sufficient penetration of wickers 46 into the wellbore W. The tubing should be lowered again to allow the control segments 33 to ratchet onto the lower mandrel 37 and remove any slack between tubing and packer.

Releasing of the tool is illustrated in FIGS. 4–6. The first step, as seen best by comparing FIG. 3 to FIG. 4, is to disengage serrated surfaces 152 and 156. This can be done by a rotary motion of lower mandrel 37. The serrated surfaces 152 and 156 are essentially mating threads which can be disengaged by relative rotary motion. The relative rotary motion succeeds in raising the upper and lower mandrels 8 and 37 as the disengagement begins to take place, as best seen by comparing FIGS. 3 and 4 in the area of serrated surfaces 152 and 156. The raising of the mandrels 8 and 37 serially places depressed surface 80 in radial juxtaposition to seal 15 to defeat the sealing of seal 15 and to equalize the pressure on either side of packing elements 18 and 20. The pressure between the wellbore W and the apparatus in the area above the packing elements 18 and 20 can bypass packing elements 18 and 20 by passing through openings 66, around the now-defeated sealing member 15, through passage 174 (see FIG. 4). Having equalized the pressure above and below packing elements 18 and 20, further upward movement of mandrels 8 and 37 places depressed surface 158 in radial juxtaposition with collet heads 61. This feature can be best seen by comparing FIG. 4 to FIG. 5. In FIG. 4, the collet heads 61 are still trapped since surface 160 is still adjacent surface 164 of collet heads 61. In this position, the compressive forces on the packing elements 18 and 20 have yet to be relaxed, as is best evident by noticing that the overall length of packing elements 18 and 20 remains the same between FIGS. 3 and 4. However, there has been relative movement between the mandrels 8 and 37 and the packing element support structure S, which can best be seen by comparing FIGS. 3 and 4 in the vicinity of serrated surfaces 152 and 156. It can be seen that in FIG. 4, serrated surface 156 has almost fully cleared the serrated surface 152.

By now comparing FIGS. 4 and 5, it can be seen that with serrated surfaces 152 and 156 still partially engaged, the seal 15 having already been defeated, as shown in FIG. 4, there has been further relative movement of upper mandrel 8 such that the collet heads 61 are released by the radial juxtaposition of surface 164 with surface 158. The juxtaposition of surfaces 158 and 164 allows the collet heads 61 to clear shoulder 162, thereby releasing the axial force holding the packing elements 18 and 20 and slips 6 in contact with the wellbore W. In effect, the upward movement of upper mandrel 8 pushes collet heads 61 along shoulder 162 so that they are inwardly deflected into depressed surface 158. The inward deflection of collet fingers 61 unleashes the axial forces exerted on packing elements 18 and 20 and they spread, as shown by comparing FIG. 4 to FIG. 5, where their overall dimension increases from 4.34 inches in the preferred embodiment to 5.654 inches. Thus, the beneficial effect of the collet system just described illustrates how the packing elements 18 and 20 are maintained in a securely sealing position (FIG. 3) until such time as it is intended to release them (FIGS. 4–6).

As also shown in FIG. 5, shoulders 56 and 54 also come into contact after collet heads 61 are released, whereupon further movement upwardly of upper mandrel 8 results in tandem movement of upper mandrel 8 with slip ring 4. This direct application of upward force on slip ring 4 through shoulder 56 on upper mandrel 8 pulls up slips 6, which in turn forces slips 6 inwardly and out of contact with the wellbore W by the interaction of ramp surfaces 50 and 48. This is illustrated by comparing FIG. 5 to FIG. 6, where it can be seen that there has been upward motion with shoulders 54 and 56 in contact, which has resulted in ramping in the slips 6. A further upward pull on top connection 1 will bring lower slips 96 from the position shown in FIG. 6 back to the position shown in FIG. 1 so that the apparatus can be removed. This occurs by a further upward pull which draws up lower locking segment 22 from the position shown in FIG. 6 to the position shown in FIG. 1. When lower locking segment 22 contacts lower gauge ring 21, the upward forces exerted by the mandrels 8 and 37, as transmitted through the joined shoulders 54 and 56, is translated from packing element mandrel 17 to lower gauge ring 21, which is threadedly connected to adjustment sleeve 24, which in turn is threadedly connected to lower cone 26, which in turn pulls slips 96 radially inward by acting on ramp surface 98 of slips 96. Continued upward movement of tubing allows the control segments 33 to automatically relatch into the groove 144 on the lower mandrel 37. Once this occurs, the tool can be lowered and reset deeper in the well, if desired.

With the above description, the advantages of the apparatus of the present invention can readily be seen. First, at the lower end of the apparatus, the disengagement between the mandrels 8 and 37 can be accomplished by a mere rotary motion without any longitudinal displacement of the mandrels 8 and 37. With the dimensions of the apparatus known, it can then be ascertained with certainty the exact location of where packing elements 18 and 20 will come in contact with the wellbore W. This is to be compared to previous release assemblies and other known packers which have required a combination of rotary and axial motion to effect the disengagement. This method has left some doubt as to the exact point of disengagement. The construction of past devices which incorporated the combined twist and translate features created uncertainty as to when the disengaging actually occurred, which disengagement in turn initiated the outward movement of the packing elements on such devices. With this apparatus, the disengagement point is known since the disengagement occurs solely by a rotational force. Having fully disengaged the lower mandrel 37 from the control segments 33, the configuration of the tool is known.

Toward its upper end, the locking feature of the collet 60 provides an added benefit over prior designs. The slips can be set for the required penetration into the wellbore W without the attendant risk of damage to the casing on removal. The locking feature of the collets 60 prevents loosening of the grip of the packing elements 18 and 20 and slips 6 while the apparatus is in use. Similarly, it retains the grip of the slips 6 when disengaging the apparatus until the pressure has been equalized on both sides of the packing elements 18 and 20. It is only then that the force holding the slips 6 in contact with the wellbore W is released, after releasing the force that holds the packing elements 18 and 20 against the wellbore W. A further feature is the use of interacting shoulders 54 and 56 to ensure ramping in of the slips 6 into complete disengagement of the wellbore to facilitate removal of the apparatus. The sequential performance of the steps of defeating seal 15, releasing the collets 60, thereby releasing the forces holding packing elements 18 and 20 in contact with the wellbore W and upper slips 6 in contact with the wellbore W, followed by a positive ramping in of the upper slips 6, minimizes the possibilities that the tool will be stuck in the wellbore W and helps to preserve the casing, if used, by the facilitation of the disengagement of wickers 46 through a positive action on ramp surface 48. A similar phenomenon occurs at lower slips 96 after the upper slips 6 have been released, wherein the lower slips 96 are ramped inwardly by forces applied to inclined surface 98.

Those skilled in the art will appreciate that certain minor modifications can be made to the apparatus of the present invention and are still intended to be within the scope of the invention. For example, the mandrel, while shown to be in two pieces 8 and 37, can be made from one piece. Various transposition of parts which can take place, for example, at the lower end of the apparatus, are intended to be within the purview of the invention. For example, the preferred embodiment has been described as having a surface 150 which is outwardly ramped by ramp 146, which is on the lower mandrel 37. The parts could easily be transposed as long as the resultant radial outward motion of control segments 33 is accomplished. Similar types of transpositions can occur in the area of seal 15 and collet heads 61. While the various components have been described in the context of a packer, it is understood that these components can be employed in a variety of tools useful in oil and gas operations.

The foregoing disclosure and description of the invention are illustrative and explanatory thereof, and various changes in the size, shape and materials, as well as in the details of the illustrated construction, may be made without departing from the spirit of the invention.

We claim:

1. A resettable downhole tool capable of being positioned in a wellbore W by connection to the lower end of a tubing string, said tool actuatable by selective relative movement between at least portions thereof and the tubing string, comprising:

a mandrel adapted for connection to the tubing string;

a support structure S mounted adjacent said mandrel;

gripping means selectively operative on said support structure S and said mandrel to selectively retain said mandrel to said support structure S;

means for supporting the weight of said support structure S against the wellbore W upon disengagement of said support structure S by said mandrel;

slip means on said support structure S for selectively fixing the position of said support structure S to the wellbore W; and said gripping means disengageable by rotation of the mandrel without any substantial movement of the mandrel along its longitudinal axis, whereupon the weight of said support structure S transfers to said support means with said weight transfer initiating at least in part actuation of said slip means into contact with the wellbore W.

2. The apparatus of claim 1, wherein said gripping means further comprises:

at least one control segment on said support structure, disposed adjacent the outer periphery of the mandrel, and disposed for radial movement with respect to the mandrel;

said control segment and said mandrel further comprising retention means and projection means selectively engageable with each other to hold said mandrel to said support structure S.

3. The apparatus of claim 2 further comprising:

camming means to outwardly force said control segment to selectively disengage said projection means from said retention means, said camming means actuatable by relative rotation between said control segment and said mandrel.

4. The apparatus of claim 3, further comprising:

axial biasing means acting on said control segment for selective axial biasing of said control segment upon action of said camming means selectively disengaging said projection means from said retention means, whereupon said axial biasing means force said projection and retention to go out of alignment to prevent re-engagement of said projection and retention means, to permit relative axial movement between said mandrel and said control segment for actuation of the tool.

5. The apparatus of claim 4, further comprising:

radial biasing means to bias said control segment toward said mandrel to retain said projection means in said retention means, said camming means selectively overcoming the force of said radial biasing means, thereby allowing said axial biasing means to axially misalign said projection and retention means after sufficient radially outward displacement of said control segment away from said mandrel, whereupon said support structure S is released from said mandrel;

said radial biasing means also biasing said control segment radially inwardly when relative movement of said mandrel with respect to said support structure S brings said projection and retention means in axial alignment to engage said support structure S to said mandrel.

6. The apparatus of claim 5, further comprising:

a plurality of control segments having the shape of longitudinal cylindrical segments;

a guide ring having a series of spaced axial projections creating gaps therebetween to accommodate said plurality of control segments for radial and axial movement;

at least one peripheral groove extending through said axial projections and a peripheral groove in said control segments;

said radial biasing means further comprising a spring mounted in said peripheral grooves when they are aligned with said projection and retention means being engaged;

said spring remaining in said grooves extending through said control segments and said axial projections when said control segments are outwardly biased by said camming means and axially biased by said axial biasing means.

7. The apparatus of claim 6, wherein:

said camming means is a ramp on said mandrel rising out of a peripheral channel thereon;

each of said control segments having a protrusion extending into said channel;

said protrusions on said segments having engagement in said channel on said mandrel before said ramp initiates outward movement of said protrusions on said control segments from said channel.

8. The apparatus of claim 7, further comprising:

a serrated surface on said control segment extending circumferentially;

a mating serrated surface on said mandrel axially displaced from said camming means;

whereupon actuation of said camming means said mandrel can move in a first direction with the subsequent engagement of said serrated surfaces, allowing further movement in that direction for further actuation of said tool by a first mode, but said serrated surfaces locking upon a movement of said mandrel in an opposite direction during serrated surface engagement, effectively preventing relative longitudinal movement between said mandrel and said control segment for alternative further actuation of said tool by a second mode, by movement of said mandrel in an opposite direction to said first direction;

said serrated surfaces selectively disengageable to reset the tool by a relative rotational movement between said mandrel and said control segments.

9. The apparatus of claim 8, further comprising:

at least one packing element mounted to said support structure S and selectively engageable upon relative axial movement of portions of said support structure S to compress said packing element to seal off the wellbore W; and said packing element and said slip means actuatable by said relative movement upon actuation of said camming means, which releases said mandrel from said control segment for relative axial movement therebetween.

10. The apparatus of claim 9, wherein:
said support structure S circumscribes said mandrel;
sealing means selectively actuated to seal between said support structure S and said mandrel when said packing element is engaged to the wellbore W.

11. The apparatus of claim 10, further comprising:
ramp means on said support structure S and said slip means to selectively force said slip means outwardly into contact with the wellbore W and to draw said slip means inwardly when said ramp means is actuated in an opposite direction;
whereupon disengagement between said mandrel and said control segment, said drag means is allowed to hold said packer support structure S stationary, while further movement of said mandrel with respect to said packer support structure S actuates said ramp means to outwardly displace said slip means.

12. The apparatus of claim 11, further comprising:
collet means on said support structure S selectively engageable with said mandrel to retain said packing element in a position where said it is outwardly extended and said ramp means has driven said slip means outwardly into contact with the wellbore W.

13. The apparatus of claim 12, further comprising:
release means operational between said mandrel and said support structure S to selectively and sequentially defeat said sealing means by provision of a gap between said sealing means and said mandrel, thereby equalizing any pressure applied to said packing element, followed by release of said collet means so that it is no longer trapped between said support structure S and said mandrel, whereupon the force on said packing element is relieved, allowing said packing element to disengage the wellbore W, followed by application of an axial force to said ramp means to draw said slip means inwardly.

14. The apparatus of claim 13, wherein:
said slip means is a plurality of slips with serrated surfaces for gripping the wellbore W, said slips disposed in at least two axially displaced groups where at least one group is disposed an axial distance on either side of said packing member;
said ramp means is a member mounted to said packing element support structure S having inclined slots disposed on either side of each of said slips, said slots engaging an inclined segment, extending from each side of said serrated surface of said slips into said slots, to contact each slip to draw it inwardly;
said release means further allowing selective application of axial force to be transmitted to said slips through said slots for selective actuation of said slips;
said release means further comprising a first and second depression in said mandrel and a release shoulder selectively providing engagement between said mandrel and said packer support structure S;
whereupon said sealing means is first defeated when movement of said mandrel places said first depression in axial alignment with said sealing means, further movement of said mandrel releases said packing element when said second depression is axially aligned with said collet means and, upon further movement of said mandrel said slips are engaged by said inclined slots when said release shoulder engages said packer support structure S for tandem movement.

15. The apparatus of claim 14, wherein:
said collet means is a plurality of collet fingers disposed between said packing element and said group of slips disposed on said packer support structure S at a higher position in the wellbore W;
said support structure S having a collet stop surface, whereupon as said mandrel is moved, said packing element is locked in an outward position when said collet fingertips engage said collet stop surface and said second depression on said mandrel is axially displaced from said collet fingertips, thereby holding said packing element in position against the wellbore W.

16. A downhole resettable packer usable in a wellbore W, comprising:
a mandrel;
packer support structure S circumscribing said mandrel;
at least one packing element mounted to said support structure S for selective outward actuation to contact a wellbore W;
at least one slip mounted to said structure for selective outward movement into contact with the wellbore W;
said mandrel initiating outward movement of said slip and said packing element via transmission of force from itself to said packer support structure S;
locking means operable on said mandrel and packer support structure S to selectively lock said packing element in its outermost position; and
said locking means releasable by relative movement between said mandrel and said packer support structure S, said relative movement releasing forces holding said packing element against the wellbore W and then retracting said slip away from the wellbore W, thus facilitating release and resetting or removal of the tool.

17. The apparatus of claim 16, wherein said locking means further comprises:
at least one collet disposed between said mandrel and said packer support structure;
a first depressed segment on said mandrel;
a stop shoulder on said support structure;
said collet trapped in a position where it locks said packing element in an outward position when said first depressed segment of said mandrel is misaligned with said collet, trapping the collet against said stop shoulder; and
drag means on said packer support structure to selectively support its weight on the wellbore, said movement of said mandrel overcoming said support provided by said drag means.

18. The apparatus of claim 17, further comprising:
sealing means selectively engageable to seal between said mandrel and said support structure S when said packing element is in selective contact with said wellbore W;
ramp means mounted to said support structure S for ramping said slips outwardly and for engaging said slips to ramp them inwardly upon selective application of force transmitted to said slips through said support structure S by movement of said mandrel;
whereupon movement of said mandrel with said packing element extended into contact with the wellbore W, said sealing means is moved out of contact between said mandrel and said support structure S to provide a fluid passage from one end of said packing element to the other while said packing element and said slips are still engaged to the wellbore W, whereupon further movement of said mandrel, said packing element is allowed to move out of contact from the wellbore W by releasing said collet from its trapped position, releasing any compressive forces applied to said packing element.

19. The apparatus of claim 18, wherein said sealing means further comprises:

a second depressed area on said mandrel;

said sealing means further comprises an internal annular seal mounted to said packer support structure S adjacent said packing element, said second depressed area misaligned from said seal to effectively seal between said packer support structure S and said mandrel when said packing element is in contact with said wellbore W, said first depressed area disposed on said mandrel to be misaligned from said collet after said second depressed area is misaligned from said seal to retain said packing element locked in an outward position, with said packing element in contact with said wellbore W until after said seal is disengaged between said mandrel and packer support structure S.

20. The apparatus of claim 19, further comprising:

at least one shoulder on said packer support structure S and a mating shoulder on said mandrel;

whereupon when the mandrel is moved in a direction to release said packing element from the wellbore W, said seal first comes into alignment with said second depression, thus opening said fluid passage, followed by said collet coming into alignment with said first depression, thus releasing applied compressive forces by said support structure S on said packing element, followed by contact of said shoulders, which in turn urges said ramp means to draw said slips inwardly to release them from the wellbore W to facilitate removal of the tool from the wellbore W.

21. The apparatus of claim 20, further comprising:

a biasing shoulder on said support structure S;

a travel stop on said support structure S adjacent said biasing shoulder;

a spring bearing on said biasing shoulder;

abutment means on said mandrel for selective contact with said spring and said biasing shoulder;

whereupon movement of said mandrel to initiate contact of said packing element with the wellbore W, said spring contacts said abutment means to transfer forces from said mandrel to said support structure S to initiate outward movement of said packing element by compression thereof due to relative movement between portions of said support structure S and to initiate said outward movement of said slips by action of said ramp means pushing on an inclined surface on said slips, whereupon further movement of said mandrel lands said abutment means on said biasing shoulder for direct transmission of force from said mandrel to said support structure S for further outward actuation of said slips and said packing element, whereupon during said mandrel movement, said collet locks said packing element in an outward position against the wellbore W.

22. The apparatus of claim 21, further comprising:

gripping means operable between said mandrel and said support structure S to selectively hold the two together when the tool is run in or out of the well and to release the support structure S for relative movement of said mandrel to allow outward extension of said packing element, said release of said support structure S from said mandrel accomplished by rotation of said mandrel about its longitudinal axis without any significant translation along its longitudinal axis.

23. The apparatus of claim 22, wherein said gripping means further comprises:

at least one control segment on said support structure S, disposed adjacent the outer periphery of the mandrel, and disposed for radial movement with respect to the mandrel;

said control segment and said mandrel further comprising retention means and projection means selectively engageable with each other to hold said mandrel to the tubing.

24. The apparatus of claim 23, further comprising:

camming means to outwardly force said control segment to selectively disengage said projection means from said retention means, said camming means actuatable by relative rotation between said control segment and said mandrel.

25. The apparatus of claim 24, further comprising:

axial biasing means acting on said control segment for selective axial biasing of said control segment upon action of said camming means selectively disengaging said projection means from said retention means, whereupon said axial biasing means force said projection and retention to go out of alignment to prevent re-engagement of said projection and retention means, to permit relative axial movement between said mandrel and said control segment for actuation of the tool.

26. The apparatus of claim 25, further comprising:

radial biasing means to bias said control segment toward said mandrel to retain said projection means in said retention means, said camming means selectively overcoming the force of said radial biasing means, thereby allowing said axial biasing means to axially misalign said projection and retention means after sufficient radially outward displacement of said control segment away from said mandrel, whereupon said support structure S is released from said mandrel;

said radial biasing means also biasing said control segment radially inwardly when relative movement of said mandrel with respect to said support structure S brings said projection and retention means in axial alignment to engage said support structure S to said mandrel.

27. The apparatus of claim 26, further comprising:

a plurality of control segments having the shape of longitudinal cylindrical segments;

a guide ring having a series of spaced axial projections creating gaps therebetween to accommodate said plurality of control segments for radial and axial movement;

at least one peripheral groove extending through said axial projections and a peripheral groove in said control segments;

said radial biasing means further comprising a spring mounted in said peripheral grooves when they are aligned with said projection and retention means being engaged;

said spring remaining in said grooves extending through said control segments and said axial projections when said control segments are outwardly biased by said camming means and axially biased by said axial biasing means.

28. The apparatus of claim 27, wherein:

said camming means is a ramp on said mandrel rising out of a peripheral channel thereon;

each of said control segments having a protrusion extending into said channel;

said protrusions on said segments having engagement in said channel on said mandrel before said ramp initiates outward movement of said protrusions on said control segments from said channel.

29. The apparatus of claim 28, further comprising:

a serrated surface on said control segment extending circumferentially;

a mating serrated surface on said mandrel axially displaced from said camming means;

whereupon actuation of said camming means said mandrel can move in a first direction with the subsequent engagement of said serrated surfaces, allowing further movement in that direction for further actuation of said tool by a first mode, but said serrated surfaces locking upon a movement of said mandrel in an opposite direction during serrated surface engagement, effectively preventing relative longitudinal movement between said mandrel and said control segment for alternative further actuation of said tool by a second mode, by movement of said mandrel in an opposite direction to said first direction;

said serrated surfaces selectively disengageable to reset the tool by a relative rotational movement between said mandrel and said control segments.

30. The apparatus of claim 1, further comprising:

at least one packing element mounted to said support structure S and selectively engageable upon relative axial movement of portions of said support structure S to compress said packing element to seal off the wellbore W; and said packing element and said slip means actuatable by said relative movement upon actuation of said gripping means, which releases said mandrel from said support structure S for relative axial movement therebetween.

31. The apparatus of claim 30, wherein:

said support structure circumscribes said mandrel;

sealing means selectively actuated to seal between said support structure and said mandrel when said packing element is engaged to the wellbore W.

32. The apparatus of claim 31, further comprising:

ramp means on said support structure and said slip means to selectively force said slip means outwardly into contact with the wellbore W and to draw said slip means inwardly when said ramp means is actuated in an opposite direction;

whereupon disengagement between said mandrel and said control segment, said drag means is allowed to hold said packer support structure S stationary, while further movement of said mandrel with respect to said packer support structure S actuates said ramp means to outwardly displace said slip means.

33. The apparatus of claim 32, further comprising:

collet means on said support structure selectively engageable with said mandrel to retain said packing element in a position where said it is outwardly extended and said ramp means has driven said slip means outwardly into contact with the wellbore W.

34. The apparatus of claim 33, further comprising:

release means operational between said mandrel and said support structure to selectively and sequentially defeat said sealing means by provision of a gap between said sealing means and said mandrel, thereby equalizing any pressure applied to said packing element, followed by release of said collet means so that it is no longer trapped between said support structure S and said mandrel, whereupon the force on said packing element is relieved, allowing said packing element to disengage the wellbore W, followed by application of an axial force to said ramp means to draw said slip means inwardly.

35. The apparatus of claim 34, wherein:

said slip means is a plurality of slips with serrated surfaces for gripping the wellbore W, said slips disposed in at least two axially displaced groups where at least one group is disposed an axial distance on either side of said packing member;

said ramp means is a member mounted to said packing element support structure S, having inclined slots disposed on either side of each of said slips, said slots engaging an inclined segment, extending from each side of said serrated surface of said slips into said slots, to contact each slip to draw it inwardly;

said release means further allowing selective application of axial force to be transmitted to said slips through said slots for selective actuation of said slips;

said release means further comprising a first and second depression in said mandrel and a release shoulder selectively providing engagement between said mandrel and said packer support structure S;

whereupon said sealing means is first defeated when movement of said mandrel places said first depression in axial alignment with said sealing means, further movement of said mandrel releases said packing element when said second depression is axially aligned with said collet means and, upon further movement of said mandrel said slips are engaged by said inclined slots when said release shoulder engages said packer support structure S for tandem movement.

36. The apparatus of claim 35, wherein:

said collet means is a plurality of collet fingers disposed between said packing element and said group of slips disposed on said, packer support structure S at a higher position in the wellbore W;

said support structure S having a collet stop surface, whereupon as said mandrel is moved, said packing element is locked in an outward position when said collet fingertips engage said collet stop surface and said second depression on said mandrel is axially displaced from said collet fingertips, thereby holding said packing element in position against the wellbore W.

37. The apparatus of claim 16, further comprising:

gripping means operable between said mandrel and said support structure S to selectively hold the two together when the tool is run in or out of the well and to release the support structure S for relative movement of said mandrel to allow outward extension of said packing element, said release of said support structure S from said mandrel accomplished by rotation of said mandrel about its longitudinal axis without any significant translation along its longitudinal axis.

38. The apparatus of claim 37, wherein said gripping means further comprises:

at least one control segment on said support structure S, disposed adjacent the outer periphery of the mandrel, and disposed for radial movement with respect to the mandrel;

said control segment and said mandrel further comprising retention means and projection means selectively engageable with each other to hold said mandrel to the tubing.

39. The apparatus of claim 38, further comprising:

camming means to outwardly force said control segment to selectively disengage said projection means from said retention means, said camming means actuatable by relative rotation between said control segment and said mandrel.

40. The apparatus of claim 39, further comprising:

axial biasing means acting on said control segment for selective axial biasing of said control segment upon action of said camming means selectively disengaging said projection means from said retention means, whereupon said axial biasing means force said projection and retention to go out of alignment to prevent re-engagement of said projection and retention means, to permit relative axial movement between said mandrel and said control segment for actuation of the tool.

41. The apparatus of claim 40, further comprising:

radial biasing means to bias said control segment toward said mandrel to retain said projection means in said retention means, said camming means selectively overcoming the force of said radial biasing means, thereby allowing said axial biasing means to axially misalign said projection and retention means after sufficient radially outward displacement of said control segment away from said mandrel, whereupon said support structure S is released from said mandrel;

said radial biasing means also biasing said control segment radially inwardly when relative movement of said mandrel with respect to said support structure S brings said projection and retention means in axial alignment to engage said support structure S to said mandrel.

42. The apparatus of claim 41, further comprising:

a plurality of control segments having the shape of longitudinal cylindrical segments;

a guide ring having a series of spaced axial projections creating gaps therebetween to accommodate said plurality of control segments for radial and axial movement;

at least one peripheral groove extending through said axial projections and a peripheral groove in said control segments;

said radial biasing means further comprising a spring mounted in said peripheral grooves when they are aligned with said projection and retention means being engaged;

said spring remaining in said grooves extending through said control segments and said axial projections when said control segments are outwardly biased by said camming means and axially biased by said axial biasing means.

43. The apparatus of claim 42, wherein:

said camming means is a ramp on said mandrel rising out of a peripheral channel thereon;

each of said control segments having a protrusion extending into said channel;

said protrusions on said segments having engagement in said channel on said mandrel before said ramp initiates outward movement of said protrusions on said control segments from said channel.

44. The apparatus of claim 43, further comprising:

a serrated surface on said control segment extending circumferentially;

a mating serrated surface on said mandrel axially displaced from said camming means;

whereupon actuation of said camming means said mandrel can move in a first direction with the subsequent engagement of said serrated surfaces, allowing further movement in that direction for further actuation of said tool by a first mode, but said serrated surfaces locking upon a movement of said mandrel in an opposite direction during serrated surface engagement, effectively preventing relative longitudinal movement between said mandrel and said control segment for alternative further actuation of said tool by a second mode, by movement of said mandrel in an opposite direction to said first direction;

said serrated surfaces selectively disengageable to reset the tool by a relative rotational movement between said mandrel and said control segments.

* * * * *